United States Patent [19]

Davis

[11] Patent Number: 5,025,688

[45] Date of Patent: Jun. 25, 1991

[54] EXPANDABLE DRIVE TOOL TIP FOR SCREW RETENTION

[75] Inventor: Richard M. Davis, Arab, Ala.

[73] Assignees: Ryder International Corp., Arab, Ala.; Textron Inc., Providence, R.I.

[21] Appl. No.: 526,607

[22] Filed: May 22, 1990

[51] Int. Cl.[5] ..... B25B 23/10

[52] U.S. Cl. ..... 81/448; 81/444; 81/453

[58] Field of Search ..... 81/436, 442, 444, 448, 81/449, 451, 452, 453

[56] References Cited

U.S. PATENT DOCUMENTS

| | | | |
|---|---|---|---|
| 1,058,454 | 4/1913 | Moores | 81/444 X |
| 2,506,922 | 5/1950 | Hansen | 81/444 |
| 2,562,347 | 7/1951 | Young | 81/444 |
| 3,150,698 | 9/1964 | Neil | 81/444 |
| 3,584,667 | 6/1971 | Reiland . | |

OTHER PUBLICATIONS

Line Head System, Inc., Fastening System brochure, date approximately 1990, General Reference.

Snap-on Medical Products, "Captive Twist" information sheet, date approximately 1990, General Reference.

*Primary Examiner*—James G. Smith

*Attorney, Agent, or Firm*—R. A. Giangiorgi

[57] ABSTRACT

A fastener drive tool for applying a rotational torque to a threaded fastener for driving the fastener into or out of a workpiece. The drive tool has an elongated shaft portion with a free end which is selectively controllably engageable with a recess formed in the fastener. The free end is formed with a fastener engaging expansion portion. The expansion portion is operated by a draw shaft being selectively lockable in a bit retaining position. The expansion portion of the bit portion creates substantial fastener retaining forces on the opposing internal surfaces of the fastener recess in which it is inserted.

13 Claims, 2 Drawing Sheets

EXPANDABLE DRIVE TOOL TIP FOR SCREW RETENTION

BACKGROUND OF THE INVENTION

This invention relates generally to the fastener drive tool art and more particularly to a fastener drive tool which retains a fastener on the end thereof.

In many fastener applications it is desirable to retain the fastener on the end of the drive tool and to prevent the fastener from wobbling while it is being driven. Retention of a fastener on the end of a drive tool allows the fastener to be driven in an area which might normally be inaccessible and permits single handed use of the drive tool since one hand is not occupied holding and positioning the fastener. In retaining a fastener on a drive tool, an easily releasable securely retaining friction fit is preferred. Prior art fastener retaining drive tools have employed retaining features including magnetic retainers, external fastener retaining fingers as well as spirally formed drive bits.

Each of the aforementioned prior art retaining features has limitations and generally results in a degree of wobble while the fastener is being driven by the drive tool. A common problem encountered by most fastener retaining drive tools is that the variation in tolerances between a drive tool bit portion and a fastener socket deter retention of the fastener on the drive tool.

The type of engagement between the fastener and the driver is very important since prior art fastener drive systems do not provide sufficient retaining forces between the driver and the fastener. For example, many prior art systems have problems with "cam out", which forces the bit portion out of the fastener recess, potentially damaging the surface of the area surrounding the fastener. Cam out occurs when driving torque is applied to the inclined walls in the recesses formed in typical prior art fasteners such as cruciforms or Philips-type fasteners. While in certain situations cam out can be overcome by increasing the end load on the driver to more securely force it into the recess, additional end load will increase the damage caused to the surrounding surface if and when the driver "cams out" of the recess.

With regard to problems with wobbling, prior art fasteners mentioned above wobble while being driven as a result of the insufficient mating between the drive tool and the fastener recess. If a fastener wobbles while being driven the fastener creates an oversized hole which decreases the degree of intimate engagement and hence retaining strength between the fastener and the object in which it is driven. Further, if the fastener is incorrectly driven, the fastener head may protrude above the surrounding surface and joined members may be misaligned.

While some prior art drivers and fasteners have been developed which substantially overcome cam out, these fasteners still may have a degree of wobble about the central axis extending through the fastener and drive tool. In one type of prior art fastener and drive tool, the fastener has a recess formed on a top surface of the head and the driver has a cooperatively mating male protrusion which is formed to engage the recess in the fastener. An example of such a fastener and driver combination is the standard hexalobular TORX fastener and corresponding driver, U.S. Pat. No. 3,584,667. The standard TORX fastener employs a driver bit which has six equidimensioned and equispaced curves lobes which engage in corresponding cross-sectional shaped recesses in the head of the fastener. The sides of the standard TORX fastener are generally parallel to the central axis. Retention of the TORX fastener on the drive tool is at least partly dependent upon the tolerances between the drive tool and the fastener and typically there is a degree of wobble resulting from variations in these tolerances.

The tolerances between the drive tool and fastener, while generally rather precise, may vary. While most fasteners are retainable on the drive tool, if a batch of fasteners are produced at the extreme of the large acceptable tolerance for fasteners and a drive tool is formed at a generally small acceptable tolerance for drive tools the fasteners probably will not be retainable on the drive tool. Further, even with minor, and acceptable, tolerance variations, a degree of wobble is created when the fastener is driven by the drive tool. The problem concerning tolerances is further exacerbated when the drive tool is used for driving a large number of fasteners such that the material on the outside of the drive tool becomes worn. Wear typically reduces the material on the outside surface of the drive tool and therefore increases the disparity between the drive tool and fastener tolerances.

In attempting to overcome some of the aforementioned problems, at least one prior art fastener and drive tool claims to overcome both retention and the wobbling problems. Such a fastener is believed to have been formed with a tool and fastener engagement design similar to the hexalobular design of a standard TORX fastener. However, this prior art device was formed with a slight spiral curve to the lobes on the outside of the drive tool and a corresponding spiral curve to the cooperatively formed mating recess in the fastener. While a fastener might be retainable on a tool using such spirally formed surfaces, it is believed that it is very difficult to remove the drive tool from the fastener once driven. Difficulty in removing the drive tool from the fastener could actually result in loosening the fastener once driven. Further, since this type of fastener and drive tool are specialized, the drive tool only drives specific types of fasteners and cannot be used with other types of standard fasteners.

Therefore, it would be preferable to provide a drive tool which is capable of retaining a fastener thereon and preventing wobble while driving the fastener. Further, it is desirable to provide a drive tool which retains a fastener on the end thereof and reduces wobble and which may be used with standard fasteners.

Further, it is desirable to provide a fastener retaining drive tool which creates substantial fastener retaining forces and which also permits the fastener to be controllably released by complete removal of such forces.

The present invention, as will be detailed more fully hereinafter, overcomes the above-described problems. More specifically, the present invention provides a drive tool which retains a fastener on the end thereof, prevents wobbling of the fastener while it is driven, is generally easily removable from the fastener and may be employed to drive standard non-specialized fasteners.

OBJECTS AND SUMMARY OF THE INVENTION

A general object of the present invention is to provide a drive tool which retains a fastener on the end thereof.

Another object of the present invention is to provide a drive tool which reduces the degree of wobble induced on the fastener while when it is driven by the drive tool.

Yet another object of the present invention is to provide a drive tool which retains a fastener on the end thereof and reduces the degree of wobble induced in the fastener while it is driven and may be employed to drive standard fasteners.

A further object of the present invention is to provide drive tool which has a bit end capable of selectively creating substantial fastener retaining forces which can be selectively released.

In accordance with the foregoing, the present invention is a fastener drive tool for applying a rotational torque to a threaded fastener for driving the fastener into or out of a workpiece. The drive tool has an elongated shaft portion with a free end which is selectively controllably engageable with a recess formed in the fastener. The free end is formed with a fastener engaging expansion portion. The expansion portion is operated by a draw shaft being selectively lockable in a bit retaining position. The expansion portion of the bit portion creates substantial fastener retaining forces on the opposing internal surfaces of the fastener recess in which it is inserted.

BRIEF DESCRIPTION OF THE DRAWINGS

The organization and manner of the operation of the invention, together with the further objects and advantages thereof may be understood best by reference to the following description taken in connection with the accompanying drawings in which like reference numerals identify like elements in which.

Figure 1:
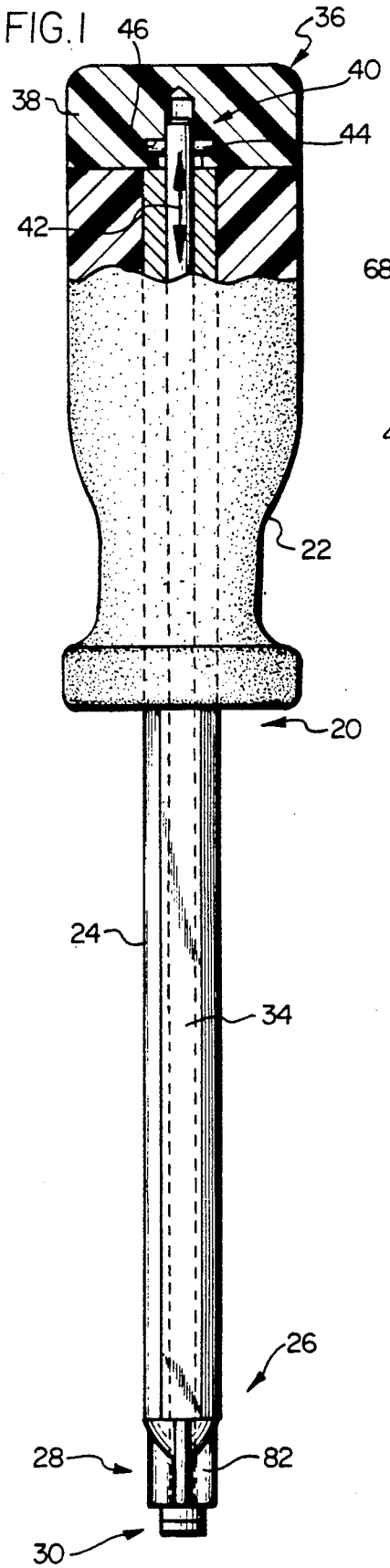
FIG. 1 is a partial fragmentary side view of a fastener drive tool having an axially operable draw shaft positioned inside a tool shank.

It should be noted that dimensional relationships between the members of the illustrated embodiment may vary in practice and may have been varied in the illustrations to emphasize certain features of the invention.

DESCRIPTION OF THE ILLUSTRATED EMBODIMENT

While this invention may be susceptible to embodiment in different forms, there is shown in the drawings and will be herein described in detail, embodiments of the present invention with the understanding that the present disclosure is to be considered an exemplification of the principles of the invention, and is not intended to limit the invention to the embodiments illustrated.

A drive tool is illustrated in FIG. 1 which has engagement means or handle 22 and a shank member 24. Engagement means 22 is referred to in FIG. 1 as a handle since in this illustration the drive tool 20 is a hand operated drive tool. However, engagement means 22 may be a socket device or other attachment device which engages a power tool which rotates the shank member 24 as desired. The shank member 24 is an elongate member with a free end 26 distal the handle 22 formed with a bit portion 28 and fastener retaining means 30 for engaging and retaining a fastener thereon.

As shown in phantom lines, a bore 32 is formed axially through the handle 22, shank member 24 and bit portion 28. A draw shaft 34 is positioned inside of the bore 34 and is axially movable within the bore by draw shaft engaging means 36. Draw shaft engaging means 36 includes a grip portion 38 on the end of the handle 22 for engaging a camming assembly 40 of known construction. The camming assembly 40 operates to axially move (as indicated by arrow 42) the draw shaft 34 within the bore 32 by means of a cam pin 44 attached to the draw shaft 34 which follows mating camming grooves (not shown) formed on the inside of the grip portion 38. While a camming apparatus of a typical or known construction is described, other draw shaft engaging means of known construction may be employed to create axial movement 42 of the draw shaft 34 within the bore 32.

Figure 2:
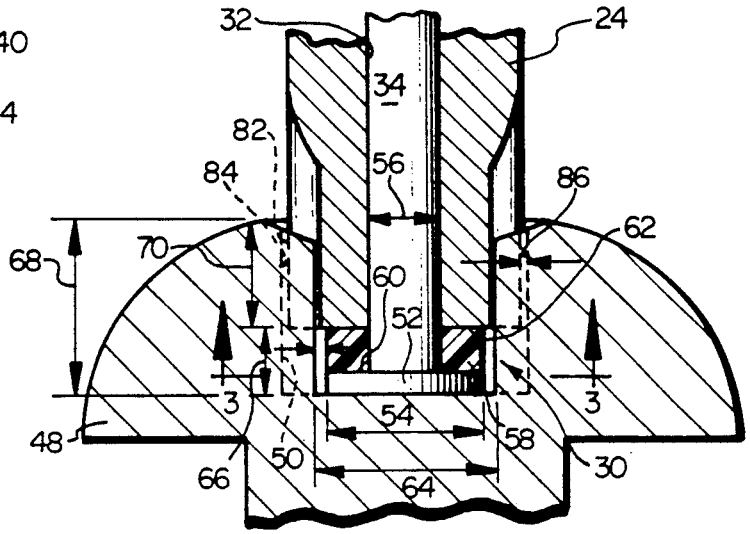
FIG. 2 is an enlarged partial sectional side view of a bit portion of the drive tool engaged with a fastener recess.

Axial movement 42 of the draw shaft 34 is important to the present invention to create fastener retaining and wobble resisting forces between the drive tool 20 and a fastener 48. As shown in FIG. 2, the bit portion 28 of the drive tool 20 is inserted into a fastener socket 50 of the fastener 48. The fastener retaining expansion means 30 is formed on the end of the shank member 24. As shown in the enlarge partial sectional view of FIG. 2, the expansion means 30 includes an enlarged head portion 52 formed on the end of the draw shaft 34 extending beyond the bit portion 28. The enlarged head portion 52 has a diameter 54 which is larger than a diameter 56 of the draw shaft 34. It is to be noted that the diameter of the bore 32 is nominally larger than the diameter 56 of the draw shaft 34 and therefore will be referred to by common reference numeral 56.

The expansion means 30 further includes an elastomeric expandable member 58 positioned between an upwardly directed face 60 of the enlarged head portion 52 and a downwardly directed face 62 of the bit portion 28. The expandable member 58 is a resiliently compressible body integrally formed of an elastically deformable material with a durometer measurement of approximately 40.

The expandable member 58 and the enlarged head portion 52 are generally formed with the same diameter 54 which is less than a smallest inside diameter 64 of the fastener socket 50. In an uncompressed state the expandable member 58 and enlarged head portion 52 have a combined length 66 which is generally less than the depth 68 of the socket 50. Since the length 66 is less than the depth 68 a length 70 of the bit portion 28 is engageable with the fastener socket 50.

Figure 3:
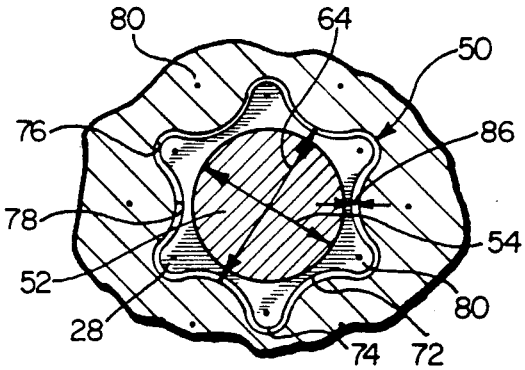
FIG. 3 is a cross-sectional view taken along line 3—3 in FIG. 2 directed upwardly towards the bit portion of the drive tool.

As shown in FIG. 3, the bit portion 28 is formed with alternating merging concave 72 and convex 74 partially-cylindrical surfaces or bit flutes and bit lobes, respectively. Likewise, the fastener socket 50 is formed with cooperative concave and convex partially-cylindrical surfaces or socket flutes 76 and socket lobes 78, respectively. Axes of curvature 80 of the concave and convex partially-cylindrical surfaces are generally parallel one another such that an outside surface 82 of the bit portion 28 is generally parallel to an inside surface 84 of the fastener socket 50.

FIG. 3 shows a partial cross-sectional view taken along line 3—3 of FIG. 2 directed up towards the drive tool 20. As shown in FIG. 3, the diameter 54 of the enlarged head portion 52 is less than the smallest inside diameter or minimum diameter 64 of the fastener socket 50. Since the diameter 54 of the enlarged head portion 52 is smaller than the diameter 64, the expansion means 30 is easily insertable into the fastener socket 50. Further, a dimensional differential or gap 86 is formed between the outside surface 82 of the bit portion 28 and the inside surface 84 of the fastener socket 50. While this gap 86 facilitates generally easy insertion of the bit portion 28 and the expansion means 30 into the fastener socket 50, the gap 86 generally prevents retention of the fastener 48 on the drive tool 20. Therefore, as will be better shown in FIG. 4, the expandable member 58 of the expansion means 30 is compressed to force the expandable member 58 outwardly to create fastener retaining and wobble resisting forces between the drive tool 20 and the fastener 48.

Figure 4:
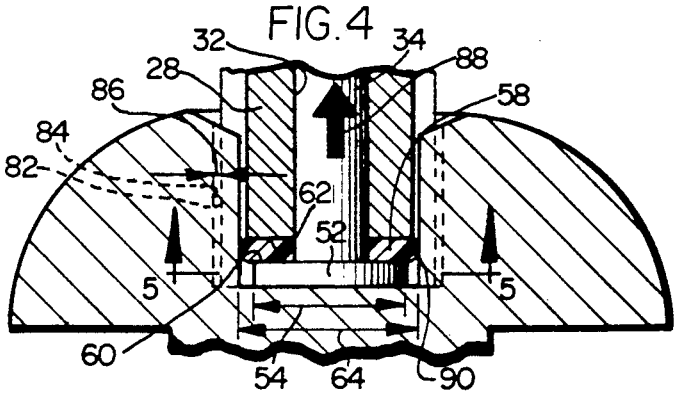
FIG. 4 is an enlarged partial sectional side view of the bit portion of the drive tool engaged with a fastener recess in which an expansion portion has been compressed to create fastener retaining forces between the bit portion and the fastener recess.

As shown in FIG. 4, the draw shaft 34 has been drawn upwardly (as indicated by arrow 88) thereby moving the enlarged head portion 52 towards the face 62 of the bit portion 28. As the head portion 52 is brought closer to the bit portion 28, the expandable material 58 is compressed therebetween. The expandable material 58 having elastically deformable characteristics, is resiliently forced outwardly away from the draw shaft 34 forming bulges 90 as it is compressed between the enlarged head portion 52 and the face 62 of the bit portion 28. The bulges 90 contact the inside surface 84 of the fastener socket 50 and create retaining forces thereon. As further shown in FIG. 4, the bulges 90 extend beyond the gap 86 and provide active positive engagement between the fastener drive tool 20 and the fastener socket 50. Generally, the expansion means 30 retain the fastener 48 on the drive tool 20 and the bit flutes 72 and bit lobes 74 engage the fastener lobes 78 and flutes 76 to impart rotational torque to the fastener once positioned as desired.

Figure 5:
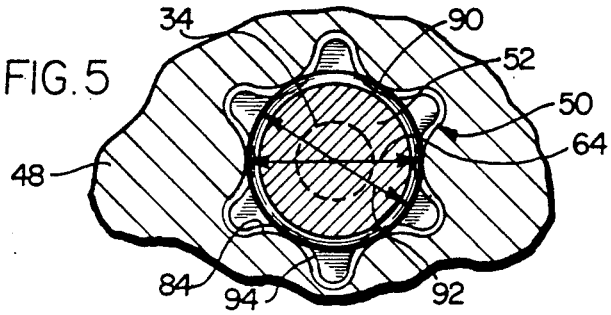
FIG. 5 is a cross-sectional view taken along line 5—5 of FIG. 4.

FIG. 5 provides further detail as to the engagement of the expandable member 58 with the inside surface 84 of the fastener socket 50. Since FIG. 5 is taken along 5—5 of FIG. 4 looking up towards the drive tool 20, in a compressed state, the bulges 90 are shown as an annular ring having a diameter 92 which is substantially equal to or slightly larger than the minimum diameter 64 of the fastener socket 50. The annular bulge 90 engages the inside surface 84 of the fastener socket 50 at engagement points 94 which are generally tangential to the apex of the socket lobes 78.

Movement of the draw shaft 34 to compress and release or expand the expandable member 58 of the expansion means 30 provides selective control for creating fastener retaining and wobble resisting forces between the drive tool 20 and the fastener 48. Further, it should be noted that the present invention is not restricted to the shape of the bit portion 28 and fastener socket 50 as illustrated in FIGS. 3 and 5. Rather, it is suggested that the advantages of the present invention provide motivation to employ the present invention with bit portions and cooperatively formed recesses of various shapes.

An alternative embodiment of the present invention is illustrated in FIGS. 6, 7, 8 and 9. The alternative embodiment employs the same principals to achieve the same function as the embodiment illustrated in FIGS. 1-5 but provides an alternative embodiment of the expansion means 30. Elements of the alternate expansion means 30*a* illustrated in FIGS. 6-9 which perform like functions to parts of the expansion means 30 are designated by like reference numerals with the suffix "a".

Figure 6:
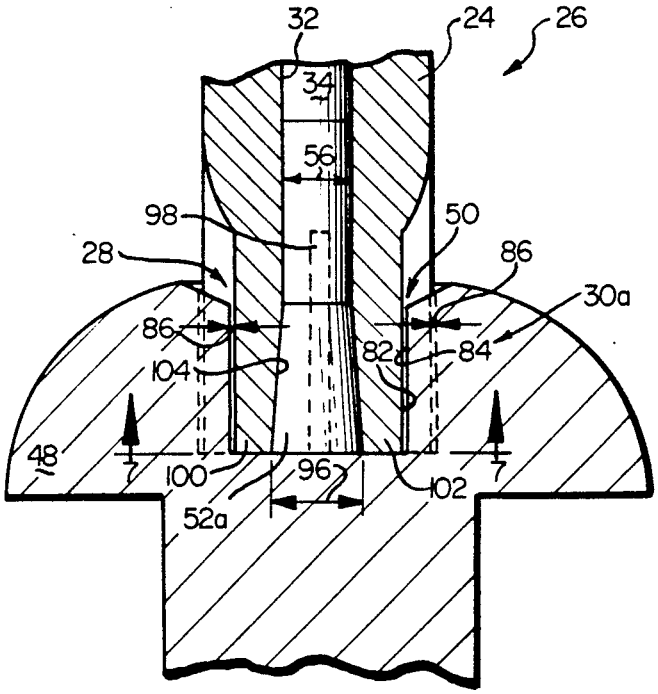
FIG. 6 is an enlarged partial sectional side view of an alternative embodiment in which the expansion portion is formed by dividing the bit portion and providing a wedge to forcibly spread the divided bit portion.

As shown in FIG. 6, the bit portion 28 is formed on a free end 26 of the shank member 24. Expansion means 30*a* are selectively controllably expandable to create fastener retaining and wobble resisting forces between the outside surface 82 of the bit portion 28 and at least a portion of the inside surface 84 of the fastener 48. The expansion means 30*a* comprise an enlarged head portion 52*a* formed on the end of the draw shaft 34. The enlarged head portion 52*a* is a generally frustoconical member with a diameter 96 at an end distal said draw shaft 34 greater than the diameter 56 of the draw shaft 34 to which it is attached.

The bit portion 28 is at least axially bifurcated, or split by cutting a slit 98 through the bit portion generally parallel the axes of curvature 80 of the bit portion 28. The slit 98 divides the bit portion 28 into a first bit portion 100 and a second bit portion 102. The first and second bit portions 100, 102 are generally symmetric about the slit 28.

Figure 7:
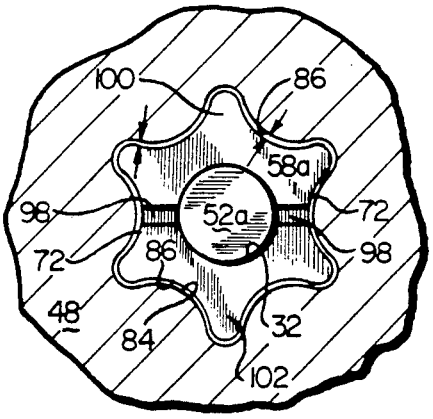
FIG. 7 is a cross-sectional view taken along line 7—7 of FIG. 6 showing the divided bit portion and wedge in a relaxed condition.
Figure 8:
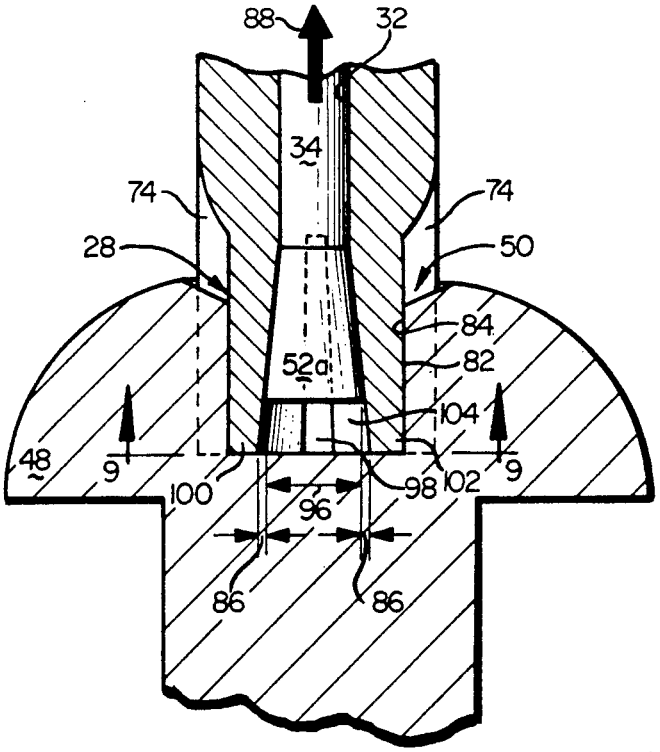
FIG. 8 is a partial sectional side view in which the wedge has been forced between the divided bit portion to forcibly spread the bit portion.

As shown in FIG. 7, a gap 86 is formed between the inside surface 84 of the fastener socket 50 and the outside surface 82 of the bit portion 28. Further, as shown in FIG. 7, the slit 98 extends outwardly from the bore 32 to concave bit flutes 72 formed on the bit portion 28.

When the draw shaft 34 is moved upwardly (as shown by arrow 88) the enlarged head portion 52*a* moves upwardly through the bore 32. A sloped inside bore surface 104 is formed to facilitate separation of the first and second bit portions 100, 102 when the enlarged head 52*a* is forced therethrough. The frustoconical shape of the enlarged head 52*a* and the sloped inside surface 104 imparts sufficient outward expansion forces on the first and second bit portions 100, 102 to force the outside surface 82 of the first and second portions 100, 102 into intimate engagement with the corresponding inside surface 84 of the fastener socket 50.

Figure 9:
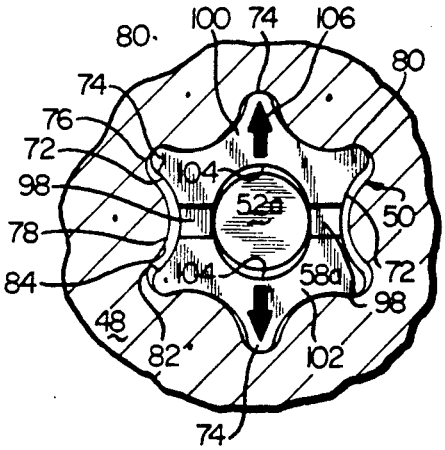
FIG. 9 is a cross-sectional view taken along line 9—9 in FIG. 8.

FIG. 9 provides further details to illustrate the engagement between the expansion means 30*a* and the fastener socket 50. Since FIG. 9 is a view taken along the line 9—9 of FIG. 8 directed upwardly towards the drive tool, a portion of the sloped inside bore surface 104 is seen as a cresent shape on either side of the enlarged head portion 52*a*. The first and second bit portion 100, 102 comprising the expandable member 58*a* of the expansion means 30*a* have been forced away from each other (as indicated by arrows 106) into intimate engagement with the corresponding portions of the fastener socket 50. Generally, when the bit portion 28 is shaped as shown and bifurcated, bit lobes 74 formed on opposite sides of the bit portion 28 from each other engage corresponding socket flutes 76 and at least a portion of the neighboring bit flutes 72 engage the corresponding socket lobes 78.

The present invention may be modified to satisfy various fastener retaining, driving and stabilizing requirements. For example, the bit portion 28 of the alternative embodiment may include expansion means 30*a* which has been divided into three or more portions as opposed to the two portions 100, 102 comprising the expandable member 58*a*. Further, the alternative embodiment need not be shaped only as shown in FIGS. 7 and 9, rather, the expansion means 30*a* may be combined with other bit portion 28 and fastener socket 50 shapes. However, it is desirable that the inside surface 84 of the fastener socket 50 and the outside surface 82 of the bit portion 28 be generally parallel to one another.

In use, the drive tool 20 is provided with engagement means 22 and a shank member 24. The shank member has a bore 32 formed axially therethrough and a draw shaft 34 axially movably positioned inside of the bore 32. The bore 32 and draw shaft 34 extend through the engagement means 22 to a camming assembly 40. The camming assembly includes cam pin 44 attached to the draw shaft 34 and engaged with cam grooves 46 therein. Rotation of the grip portion 38 engages the camming assembly 40 to axially move 42 the draw shaft 34 through the bore 32.

Movement of the draw shaft 34 through the bore controllably expands and contracts the expansion means 30, 30*a* formed on the free end 26 of the shank member 24. A bit portion 28 provides driving engagement with a fastener socket 50 formed in the fastener 48. Upward axial movement 88 of the draw shaft 34 moves an enlarged head portion 52, 52*a* upwardly to forcibly expand the expansion means 30, 30*a*. The outward movement of the expansion means 30, 30*a* creates fastener retaining and wobble resisting forces by forcing the outside surface 82 of the bit portion 28 into intimate engagement with the inside surface 84 of the fastener socket 50. The camming assembly 40 provides locking means 108, of a known construction, to retain the draw shaft 34 in the upwardly drawn position to retain the fastener 48 on the drive tool 20.

Rotational force is transferred from the drive tool 20 to the fastener 48 by engagement of the bit portion 28 with the fastener socket 50. Once the fastener 50 is driven into or removed from a workpiece, the locking means 108 is disengaged thereby controllably contracting the expansion means 30, 30*a* to remove the fastener retaining and wobble resisting forces to permit removal of the bit portion 28 from the fastener socket 50.

While preferred embodiments of the present invention are shown and described, it is envisioned that those skilled in the art may devise various modifications of the present invention without departing from the spirit and scope of the appended claims.

The invention is claimed as follows:

1. A fastener drive tool for imparting rotational torque to a fastener, said drive tool comprising: an elongate shank member; a bit portion formed on an end of said shank member for cooperatively engaging a drive socket formed in said fastener; a bore axially extending through said shank member; a draw shaft axially movably positioned in said bore; fastener retaining expansion means formed on an end of said shank and said draw shaft, said fastener retaining expansion means including a resiliently compressible member operatively retained on an end of said bit portion and operatively engaged with said draw shaft, said resiliently compressible member radially outwardly expanding when compressed for engaging said socket formed in said fastener creating fastener retaining a wobble resisting forces between said drive tool and said fastener, said resiliently compressible member being selectively contractable for releasing said drive tool from said fastener.

2. A fastener drive tool according to claim 1, wherein said bit portion is formed with an outside surface and said socket is formed with an inside surface, said outside surface of said bit portion cooperatively engaging said inside surface of said socket, said inside and outside surfaces being formed with cooperative alternating merging concave and convex partially cylindrical surfaces; axes of curvature of said concave and convex partially cylindrical surfaces being generally parallel one another; said expansion means creating fastener retaining and wobble resisting forces when at least a portion of said resiliently compressible member is compressed and radially expanded outwardly against at least a portion of two of said concave and convex partially cylindrical surfaces formed on said inside surface of said socket.

3. A fastener drive tool according to claim 2, wherein said resiliently compressible member is compressed for radially expanding said resilient compressible member substantially perpendicular to said axes of curvature for creating fastener retaining and wobble resisting forces between said convex partially cylindrical surfaces formed on the inside surface of said fastener socket.

4. A fastener drive tool according to claim 2, wherein said resiliently compressible member is substantially compressed against and creates fastener retaining and wobble resisting forces between non-neighboring concave partially cylindrical surfaces and at least a portion of the nearest neighboring convex partially cylindrical surfaces to the concave partially cylindrical surfaces between which said resiliently compressible member deforms when it is compressed.

5. A fastener drive tool for imparting rotational torque to a fastener and for selectively actively engaging and retaining said fastener on said drive tool, said drive tool comprising: an elongate shank member, a bit portion formed on a free end of said shank member for cooperatively engaging a socket formed in said fastener; a bore axially extending through said shank member; a draw shaft axially movably positioned in said bore; expansion means formed on an end of said shank member and said draw shaft, said expansion means being engageable with said socket formed in said fastener and being selectively controllably expandable for creating fastener retaining and wobble resisting forces between said drive tool and said fastener, said expansion means being selectively controllably contractable to release said drive tool from said fastener; said expansion means comprising an enlarged head portion formed on an end of said draw shaft spaced a distance from a face of said free end of said shank and being insertable into said socket, a resiliently compressible member positioned between said enlarged head and said face of said free end of said shank, said resiliently compressible member forming outwardly compressed bulges when said draw shaft is moved to bring the enlarged head closer to the free end compressing the resiliently compressible member positioned therebetween for creating engaging forces between outwardly compressed bulges of said resiliently compressible member and an opposed surface of said socket formed in said fastener.

6. A fastener drive tool according to claim 5, wherein said enlarged head and said resiliently compressible member have a diameter being smaller than a diameter of said fastener socket to facilitate insertion of said bit portion, enlarged head and resiliently compressible member into said fastener socket.

7. A fastener drive tool according to claim 5, wherein a length dimension of said enlarged head and said resiliently compressible member is less than a depth dimension of said fastener socket for engaging a portion of an outside surface of said bit portion with an inside surface of said fastener socket.

8. A fastener drive tool according to claim 5, further including draw shaft engaging means for providing a mechanical advantage for axially moving said draw shaft to compress said resilient compressible member for creating said fastener retaining and wobble resisting forces between said drive tool and said fastener.

9. A fastener drive tool according to claim 8, wherein said draw shaft engaging means comprises a camming assembly for cammingly moving said draw shaft through said bore for compressing said resiliently compressible member.

10. A fastener drive tool according to claim 8, wherein said draw shaft engaging means include locking means for selectively locking and retaining said fastener retaining and wobble resisting forces between said drive tool and fastener.

11. A fastener drive tool according to claim 5, wherein said bit portion is formed with an outside surface and said socket is formed with an inside surface, said outside surface of said bit portion cooperatively opposing said inside surface of said socket, said inside and outside surfaces being formed with cooperative alternating merging concave and convex partially cylindrical surfaces; axes of curvature of said concave and convex partially cylindrical surfaces being generally parallel one another; said resiliently compressible member forcibly engaging and generally conforming to at least a portion of said concave and convex partially cylindrical surfaces formed on said inside surface of said socket when compressed between said enlarged head and face of said free end of said shank for retainably engaging the fastener with which said drive tool is engaged on an end thereof.

12. A fastener drive tool according to claim 11, in which said resiliently compressible member forcibly engages at least one convex partially cylindrical surface formed on the inside of said fastener socket.

13. A fastener drive tool for imparting rotational torque to a fastener, said drive tool comprising: an elongate shank member; a bit portion formed on an end of said shank member for cooperatively engaging a drive socket formed in said fastener, said bit portion being formed with an outside surface and said socket being formed with an inside surface, said outside surface of said bit portion cooperatively engaging said inside surface of said socket, said inside and outside surfaces being formed with cooperatively alternating merging concave and convex partially cylindrical surfaces, axes of curvature of said concave and convex partially cylindrical surfaces being generally parallel one another; a bore axially extending through said shank member; a draw shank axially movably positioned in said bore; fastener retaining expansion means formed on an end of said shank and said draw shaft, said fastener retaining expansion means including a resiliently compressible member operatively retained on an end of said bit portion and operatively engaged with said draw shaft, said resilient compressible member is compressed for radially expanding said resilient compressible member substantially perpendicular to said axes of curvature for creating fastener retaining and wobble resisting forces between said convex partially cylindrical surfaces formed on said surface of said fastener socket.

* * * * *